United States Patent [19]

Fitts

[11] 4,370,586

[45] Jan. 25, 1983

[54] IMAGE INTENSIFIER TUBE HAVING AN INTERNAL ALKALI BAFFLE

[75] Inventor: Robert W. Fitts, Lititz, Pa.

[73] Assignee: RCA Corporation, New York, N.Y.

[21] Appl. No.: 248,062

[22] Filed: Mar. 27, 1981

[51] Int. Cl.[3] ..... H01J 31/50; H01J 40/06

[52] U.S. Cl. ..... 313/102; 313/181

[58] Field of Search ..... 313/102, 101, 94, 98, 313/181; 316/9

[56] References Cited

U.S. PATENT DOCUMENTS

| | | | |
|---|---|---|---|
| 2,244,720 | 6/1941 | Massa et al. | 250/165 |
| 2,752,519 | 6/1956 | Ruedy | 313/102 X |
| 3,894,258 | 7/1975 | Butterwick | 313/102 |
| 4,157,484 | 6/1979 | Stowe et al. | 313/94 |
| 4,173,727 | 11/1979 | Vine | 313/102 X |
| 4,198,106 | 4/1980 | Stowe et al. | 316/4 |
| 4,315,184 | 2/1982 | Santilli et al. | 313/102 X |

*Primary Examiner*—Palmer C. Demeo

*Attorney, Agent, or Firm*—Eugene M. Whitacre; Dennis H. Irlbeck; Vincent J. Coughlin, Jr.

[57] ABSTRACT

An image intensifier tube includes a substantially cylindrical envelope having a photoemissive cathode at one end and a phosphor screen at the other end. A tubulation extends through the envelope wall for introducing a constituent of the cathode into the envelope. A baffle ring comprising an insulative material is located within the tube adjacent to the tubulation. The baffle ring forms an interior annular chamber with the cylindrical envelope. An annular passage is formed between the baffle ring and an inwardly-extending portion of the envelope.

12 Claims, 3 Drawing Figures

IMAGE INTENSIFIER TUBE HAVING AN INTERNAL ALKALI BAFFLE

BACKGROUND OF THE INVENTION

The invention relates to image intensifier tubes, and more particularly to a magnetically-focused image intensifier tube having an internal alkali baffle which permits the external location of the alkali vapor sources used to form the photoemissive cathode of the tube.

An image tube is a type of tube which employs a photoemissive cathode or photocathode which is sensitive to radiation across a particular wavelength region of the electromagnetic spectrum. When exposed to such radiation, electrons are emitted from the photocathode and are caused to travel to a phosphor-coated anode or screen where they strike the phosphor giving off light. Magnetically-focused image intensifier tubes combine an electrostatic accelerating field with an axial magnetic-focusing field provided either by a solenoid or a permanent magnet. The uniform magnetic field provides good resolution over the entire phosphor screen with minimum image distortion.

In prior art magnetically-focused image intensifier tubes, the alkali vapor sources for forming the photocathode were located within the evacuated envelope structure. One of the drawbacks of having the alkali vapor sources internal to the envelope was that photocathodes formed in such tubes often showed variations in spectral sensitivity which, in some instances, were extreme. For example, some tubes having the well-known S-20 multialkali photocathode were fabricated in which the spectral sensitivity at 420 nanometers often varied by only a few percent; however, the spectral sensitivity variation at 800 nanometers in the same tubes often approached fifty percent. It is believed that nonuniform spectral sensitivity at various wavelengths is caused primarily by nonuniform sodium distribution within the photocathode.

The formation of photocathodes within image intensifier tubes by means of an "external" evaporation process is described in U.S. Pat. No. 2,244,720 issued to Massa et al. on June 10, 1941. In U.S. Pat. No. 2,752,519 issued to Ruedy, on June 26, 1956, a connected external chamber houses a substance that is inserted into the main envelope of the tube to form the photocathode. After forming the photocathode, the holder is retracted into the chamber. Both the Massa et al. and the Ruedy patents show an internally-disposed apertured element adjacent to the external alkali chamber that permits the alkali materials from the chamber to pass directly into the vacuum enclosure. In the Massa et al. structure, the apertured element adjacent to the external alkali source does nothing to provide a uniform distribution of alkali material and causes a nonuniform spectral variation in the photocathode produced thereby.

An improved structure for externally processing a photocathode is shown in U.S. Pat. No. 3,894,258 issued to Butterwick on July 8, 1975. The Butterwick structure shows a baffle chamber adjacent to the anode element of a proximity-focused image tube. A drawback of the Butterwick structure is that the alkali material which evolves from the baffle chamber through a space adjacent to the phosphor screen tends to contaminate the screen during the formation of the photocathode. Only by providing a suitably thick aluminized layer over the phosphor screen is alkali contamination prevented. However, a thick aluminum layer reduces the energy of the electrons which reach the screen and thereby lowers the gain of the tube.

U.S. Pat. No. 4,157,484 issued to Stowe et al. on June 5, 1979 and U.S. Pat. No. 4,198,106 issued to Stowe et al. on Apr. 15, 1980, show a typical electrostatically-focused image tube having an external alkali processing system and a baffle structure incorporated therein. In the image tube of the Stowe et al. patents, the baffle system is located adjacent to the photocathode and comprises a metal vapor shield which forms a part of the focusing structure for the electrons leaving the photocathode. The Stowe et al. baffle structure is not applicable to magnetically-focused image intensifier tubes since the metallic baffle structure of the Stowe et al. patents would distort the uniform electrostatic accelerating field adjacent to the photocathode. The metal vapor shield also would dangerously increase the voltage gradients in a magnetically-focused image intensifier tube. Likewise, the baffle structure of the Butterwick patent, in which the baffle chamber is adjacent to the anode, is also unusable in a magnetically-focused image intensifier tube since the screen of a magnetically-focused image intensifier tube is exceptionally prone to alkali contamination especially in multistage structures where it is impossible to heat the screen to a higher temperature than the cathode as suggested in the Butterwick patent to minimize alkali contamination of the phosphor.

SUMMARY OF THE INVENTION

An image intensifier tube includes a substantially cylindrical envelope having a photoemissive cathode at one end and a phosphor screen at the other end. A tubulation extends through said envelope for introducing a constituent of said cathode into said envelope. A baffle ring is located within the tube adjacent to said tubulation. Said baffle ring forms an interior annular chamber with said cylindrical envelope. An annular exit passage is formed between said baffle ring and an inwardly-extending portion of said envelope.

DETAILED DESCRIPTION OF THE PREFERRED EMBODIMENT

Figure 1:
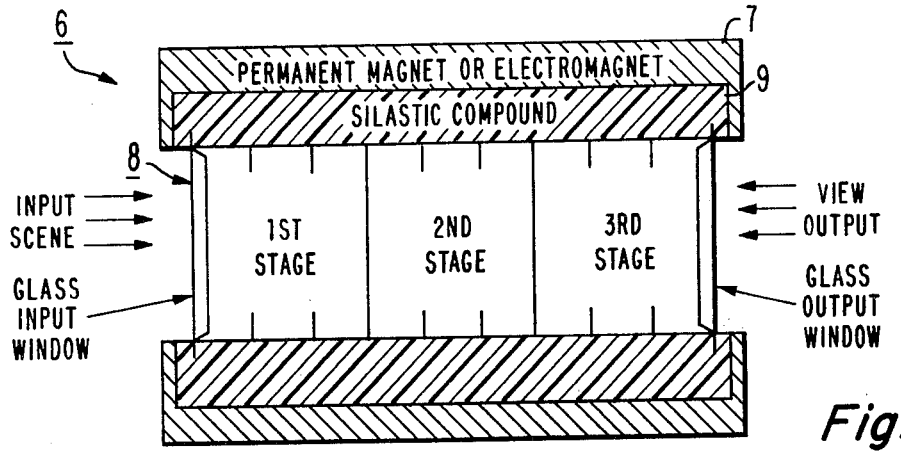
FIG. 1 is a longitudinal schematic view, in cross-section of a three-stage magnetically-focused image intensifier tube system.
Figure 2:
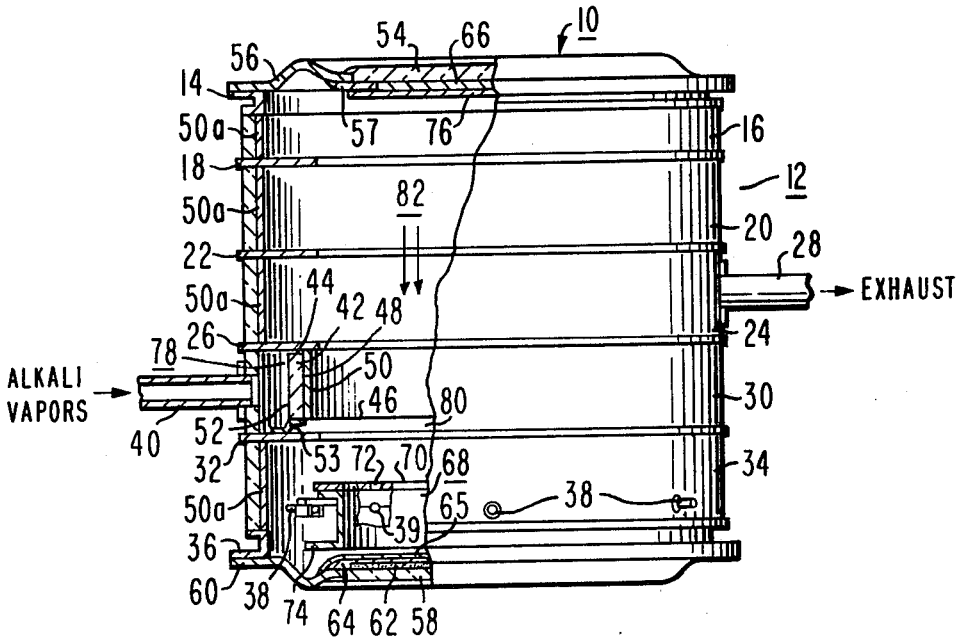
FIG. 2 is a longitudinal view, partially broken away embodiment, of a single-stage magnetically-focused image intensifier tube incorporating the present novel baffle structure.

Referring generally to FIG. 1, a three-stage magnetically-focused image intensifier tube system 6 comprises a focusing magnet or solenoid 7 insulatingly spaced from an intensifier tube 8 by a resilient insulating material 9, such as RTV silastic compound. A single-stage tube 10 similar to one stage of the three-stage magnetically-focused image intensifier tube system 6 is shown in FIG. 2. The tube 10 comprises a vacuum envelope 12 which includes a substantially cylindrical wall. The cylindrical wall is comprised of several annular components. First, a metallic window mounting flange 14 is sealed to one end of an insulating ring 16. The insulating rings described herein may comprise glass or a high alumina ceramic having an alumina content of at least 95 percent. A first conductive annular electrode 18 is sealed to the opposite end of the insulating ring 16. A second insulating ring 20 is sealed between the first conductive annular electrode 18 and a second conductive annular electrode 22. A third insulating ring 24 is sealed to the other side of the second conductive annular electrode 22 and also to a third conductive annular electrode 26. An exhaust tubulation 28 is attached to the third insulating ring 24. If the insulating ring 24 comprises glass, the tubulation 28 is a glass member sealed into the ring 24; however, if the ring 24 comprises a ceramic member, the tubulation 28 comprises a tubular copper member brazed to the ceramic ring 24. A fourth insulating ring 30 is sealed between the third conductive annular electrode 26 and a fourth conductive annular electrode 32. A fifth insulating ring 34 is sealed between the fourth conductive annular electrode 32 and a metallic screen output window mount flange 36. The fifth insulating ring 34 has a plurality of mounting pins 38 extending circumferentially through the body of the insulating ring 34 and sealed thereto. The sealing method depends on the ring material used. If the ring comprises glass, the pins are heat-sealed therein. If the ring 34 is a ceramic material, the pins are brazed into apertures by a method well known in the art. The pins 38 are designed to support and provide electrical access to a plurality of antimony beads 39 that are distributed around the inner periphery of the fifth insulating ring 34. The fourth insulating ring 30 also has an alkali vapor tubulation 40 sealed thereto in a manner identical to that described above for the tubulation 28 sealed to the ring 24. The tubulation 40 provides a conduit through which alkali material from an external alkali generator (not shown) enters the evacuated interior of the envelope.

A novel baffle ring 42 of an insulative material is attached to one of the inwardly-extending annular electrodes. In the embodiment shown in FIG. 2, the proximal end 44 of the baffle ring 42 is brazed to one surface of the conductive annular electrode 26. The diameter of the baffle ring is less than the inside diameter of the conductive annular electrode 26 so that the baffle ring is recessed by about 3 to 4 mm (millimeters) from the inside diameter of the conductive annular electrode 26. The adjacent fourth conductive annular electrode 32, which also has an inside diameter substantially equal to that of the third conductive annular electrode 26, is in close proximity to the distal end 46 of the baffle ring 42.

The baffle ring 42 is preferably coated on an inner exposed surface 48 with a thin uniform chromic oxide, $Cr_2O_3$, layer 50. The chromic oxide layer may be sprayed or painted onto the baffle ring 42. The outer surface 52 of the ring 42, facing the envelope wall, is preferably free of chromic oxide since chromic oxide reacts with and getters alkali metal vapor. The chromic oxide layer is generally fired at an elevated temperature to make it adhere to the surface of the ring 42. The purpose of the chromic oxide layer is to provide a path for draining away electrostatic charge, thus preventing an electrostatic charge buildup while providing a resistance great enough to prevent an appreciable leakage current during tube operation. The chromic oxide is high resistive material having a resistance of at least about $10^{13}$ ohms per square. To further reduce the possibility of charge buildup, the distal end 46 of the baffle ring 42 is metallized and plated and a nonmagnetic strap 53 is brazed between the distal end 46 of the ring 42 and the adjacent conductive electrode 32. Charging of the chromic oxide may occur either through a difference of potential which is required across the various tube electrodes to accelerate electrons emitted from the photocathode toward the phosphor screen or through electron impingement on the surface of the ring. All the envelope rings with the exception of the fourth envelope ring 30 are also coated on the inside surface with a thin uniform layer **50*a*** of chromic oxide to prevent an electrostatic buildup thereon.

The tube 10 further comprises an input window 54 attached to a cathode bulb flange 56 which is sealed, for example by heliarc welding, around the periphery of the flange to the metallic window mount flange 14 at one end of the envelope 10. The input window 54 has a thin annular aluminum band 57 evaporated on the inner surface thereof to make electrical contact with the cathode bulb flange 56. An output window 58 is attached to a screen bulb flange 60 which is sealed to the other end of the envelope 10, for example by heliarc welding, to the output window mount flange 36. A phosphor screen 62, which may comprise P-11, P-20 or any other suitable phosphor material, a bright aluminized layer 64 and a dark aluminum layer 65 are disposed on an interior surface of the output window 58. The combination of the bright and the dark aluminum layers 64 and 65, respectively, enhance the contrast of the electron image formed on the phosphor screen 62. The formation of bright and dark aluminum layers are well known in the art and need not be described.

The antimony beads 39 attached to the pins 38 in the fifth insulating ring 34 are oriented so that when an electrical current is applied thereto, a film 66 of antimony is deposited on the interior surface of the input faceplate 54. A shield assembly 68 comprising a top plate 70 having a plurality of antimony directing apertures 72 therethrough and having a closed bottom surface 74 prevents antimony from being evaporated onto the aluminized layers 64 and 65 of the screen 62.

A photocathode 76 is formed on the interior surface of the input window 54 by causing the externally-located alkali metal sources (not shown) to uniformly react with the antimony film 66 disposed on the window 54. The alkali vapor sources are activated, for example by electrical resistance heating, and the alkali vapors enter the envelope 12 through the tubulation 40. The photocathode 76 may comprise, for example a potassium-sodium-cesium-antimony cathode structure or any other suitable photocathode structure known in the art. The alkali vapors impinge upon the baffle ring 42 and are dispersed circumferentially about the interior of the tube within a baffle chamber 78 which is defined as the region bounded by surface portions of the baffle ring 42, the conductive annular electrode 26, the insulating ring 30 and the adjacent annular electrode 32. The alkali vapors from the baffle chamber 78 enter the tube 10 through an annular alkali vapor passage 80 which is formed by the space between the distal end 46 of the baffle ring 42 and the adjacent electrode 32. This space is relatively small and in the range of about 1.27 mm to about 1.78 mm.

The baffle structure described herein provides the potential for producing photocathodes having higher spectral response and greater uniformity than heretofore has been obtained by processing the photocathode with alkali sources contained within the tube.

In the operation of the magnetically-focused image tube described herein, each of the conductive annular electrodes operates at progressively higher voltages. For example, the cathode bulb flange is typically operated at ground potential and each of the subsequent electrodes is operated at 3 kV above the preceding electrode. In the structure shown in FIG. 2, electrode 18 is operated at 3 kV, electrode 22 at 6 kV, electrode 26 at 9 kV, electrode 32 at 12 kV, and the screen electrode 36 at 15 kV. In a single-stage magnetically-focused image intensifier, an axial magnetic field of about 180 gauss is required to focus the image. In a three-stage tube such as that shown in FIG. 1, each stage is operated at 15 kV and a magnetic field of about 180 gauss is required. The electrostatic field gradient created by the operating voltages described above preclude the use of metal baffle structures such as those shown in the above-referenced Stowe et al. patents and the Butterwick patent. Each of those structures would severely distort the electrostatic field between adjacent electrodes and would cause high field gradients which would result in possible electrical breakdown and subsequent destruction of the image tube. The baffle chamber 78 described herein is located between and spaced from the input window 54 and the phosphor screen 62 and thus permits the formation of uniform photocathodes without the risk of phosphor screen contamination. The recessed baffle chamber 78 also is laterally displaced from the electrode paths 82 which extend between the photocathode 76 and the screen 62, thus the baffle chamber does not interfere with or influence the electrons traveling toward the screen.

Figure 3:
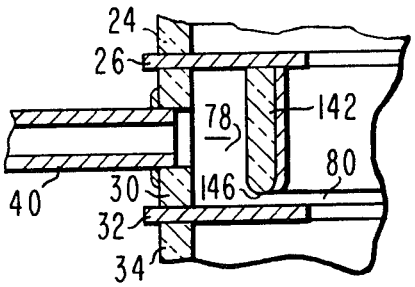
FIG. 3 is a partial fragmentary view of another embodiment of the novel baffle structure wherein the baffle ring has a rounded distal end.

As shown in FIG. 3, it has been determined that by rounding the distal end 146 of a baffle ring 142 to a full radius, even greater electrical integrity can be achieved since the likelihood of field emission from the corners of the baffle ring is eliminated. While FIG. 2 shows only a single-stage intensifier, it should be understood that the above-described novel alkali baffle also is applicable to multistage magnetically-focused image intensifier tubes.

What is claimed is:

1. In an image intensifier tube including a substantially cylindrical envelope having a photoemissive cathode at one end and a phosphor screen at the other end, said envelope also including a tubulation extending therethrough for introducing a constituent of said cathode, the improvement comprising a baffle ring of an electrically insulative material located inside said tube adjacent said tubulation, said baffle ring forming an interior annular chamber with said cylindrical envelope, the chamber having an annular exit passage between said baffle ring and an inwardly-extending portion of said envelope.

2. The tube as defined in claim 1 including said baffle ring having a resistive coating disposed on one surface thereof.

3. A magnetically-focused image intensifier tube having:

a. A vacuum envelope including;

i. a substantially cylindrical body comprising a plurality of conductive annular electrodes separated by insulating rings having an interior surface and an exterior surface, said electrodes extending radially inward from said interior surface of said insulating rings, ii. a transparent input window sealed to one end of said body, iii. an output window sealed to another opposed end of said body, said envelope enclosing an evacuated interior which extends between said opposed ends and said body, b. a photoemissive cathode formed on said input window;

c. a phosphor screen disposed within said interior of said envelope on a surface of said output window; and d. an exhaust tubulation extending through one of said insulating rings and sealed thereto, the improvement comprising:

a baffle ring of an insulative material within the evacuated interior of said envelope, said ring being disposed between and spaced from said input window and said phosphor screen, said ring having a proximal end and a distal end, said proximal end being attached to one of said inwardly-extending annular electrodes, said baffle ring having a resistive coating uniformly disposed on one surface thereof to prevent an electrostatic charge buildup thereon, said baffle ring being spaced from said interior surface of another one of said insulating rings and proximate to but spaced from an adjacent inwardly-extending annular electrode thereby forming a baffle chamber, said baffle chamber comprising an unimpeded vapor channel extending circumferentially around an enclosed portion of said evacuated interior of said envelope bounded by surface portions of said baffle ring, said one conductive annular electrode, another one of said insulating ring and said adjacent annular electrode, an alkali vapor tubulation extending through another one of said insulating rings for introducing alkali vapor into said baffle chamber, and an alkali vapor passage between said baffle chamber and said evacuated interior of said envelope, said vapor passage being defined by the space between said distal end of said baffle ring and said adjacent conductive annular electrode.

4. The tube as in claim 3 wherein said distal end of said baffle ring is formed to a full radius.

5. The tube as in claim 4 wherein said alkali vapor passage comprising said space between said distal end of said baffle ring and said adjacent conductive annular electrode is about 1.27 mm to about 1.78 mm.

6. The tube as in claim 3 wherein said resistive coating on said exposed surface of said baffle ring has a resistance value of at least about $10^{13}$ ohms per square.

7. The tube as in claim 6 wherein said resistive coating comprises chromic oxide.

8. The tube as in claim 7 wherein said chromic oxide is disposed on a surface of said baffle ring adjacent to the inside diameter of said ring, said chromic oxide coating contacting said one inwardly-extending annular electrode.

9. The tube as in claim 3 wherein said baffle ring and said insulating rings comprise a high alumina ceramic.

10. The tube as in claim 9 wherein said ceramic rings are brazed to said conductive annular electrodes.

11. The tube as in claim 9 wherein said distal end of said baffle ring includes a metallized and plated layer thereon.

12. The tube as in claim 11 wherein a nonmagnetic strip is attached between said distal end of said baffle ring and said adjacent annular electrode.

* * * * *